United States Patent [19]

Russell

[11] 4,087,206

[45] May 2, 1978

[54] SUBSURFACE PUMPING UNIT INCORPORATING HEAVY DUTY REVERSING VALVE AND METHOD OF OPERATING

[75] Inventor: Carl D. Russell, Sallisaw, Okla.

[73] Assignees: Robert G. Brooks; Wretha M. Brooks, both of Tulsa, Okla.

[21] Appl. No.: 689,571

[22] Filed: Jun. 3, 1976

[51] Int. Cl.[2] ..... F04B 17/00; F01L 21/04

[52] U.S. Cl. ..... 417/53; 417/404; 91/228; 91/229; 91/342

[58] Field of Search ..... 417/398, 399, 401, 403, 417/404, 53; 91/286, 287, 329, 341 R, 348, 342, 228, 229; 137/596.18, 625.48

[56] References Cited

U.S. PATENT DOCUMENTS

| | | | |
|---|---|---|---|
| 1,441,017 | 1/1923 | Mattson et al. | 91/329 |
| 2,146,213 | 2/1939 | Horton | 417/404 |
| 2,727,467 | 12/1955 | Russell | 417/404 |
| 3,236,441 | 2/1966 | Russell | 417/393 |

*Primary Examiner*—Carlton R. Croyle
*Assistant Examiner*—Thomas I. Ross

[57] ABSTRACT

The invention relates to apparatus for and the method of reversing the operation of a power piston in a power cylinder automatically to pump oil, corrosive or wax bearing fluids. The flow of high pressure fluid driving the piston in one direction may be reversed to drive the piston in the opposite direction at the end of the respective strokes by establishing a collapsible chamber for the high pressure fluid within the piston. This chamber is at least partially collapsed toward the end of each stroke by the stem of an auxiliary reversing piston striking a stop slightly before the end of the stroke to partially collapse said chamber and establish a further chamber on the opposite side of the reversing piston. At the conclusion of each stroke, all valving is closed and the high pressure within the collapsible chamber now exerts force against the reversing piston, but since the stem of the reversing piston is against the stop, the force is oppositely directed to reverse the direction of the power piston by collapsing the second-mentioned chamber, while exhausting the same to crack the valving ports and enable the high pressure to drive the piston in the opposite direction. The provision of a single large passage for exhausting the second chamber is of particular significance in reliable operation.

6 Claims, 7 Drawing Figures

SUBSURFACE PUMPING UNIT INCORPORATING HEAVY DUTY REVERSING VALVE AND METHOD OF OPERATING

PRIOR ART

A very important purpose of the present invention is to serve as an improved deep well pump to produce or scavenge oil from oil holes which may extend thousands of feet into the earth. My prior U.S. Pat. No. 3,236,441 issued Feb. 22, 1966, also provides an automatically reversible valve and pump arrangement for deep well use, but the subject invention improves over the same by permitting freer passage of the operating fluids, through the use of fewer components, to provide a more reliable deep well pumping system. This is particularly important when it is realized the large cost of installing such apparatus in a well so deep.

Generally, the recovery system employs a hydraulically operated motor in combination with a fluid pump for insertion into the deep well, where at least the pump is submerged, and fluid is forced down a shaft at, e.g., 5 to 10 psi to power the motor piston, and the pump recovers production fluids on each up and down reciprocal stroke, such that 2 gallons of production fluid may be pumped to a farm truck for each gallon of operating fluid pumped down to the motor.

The reversing valve of the present invention enables such remote automatic reversing of the motor at the end of each stroke as to reciprocate the pump from the unidirectional flow operating fluid pumped down from the surface. This valve comprises a power piston in a power cylinder housing with a portion of the power piston being a movable member comprising an exhaust valve portion and an inlet valve portion disposed within the cylinder.

Within the power piston there is located opposed, spaced apart reversing pistons, each having a reversing piston stem respectively extending in opposite directions longitudinally of the power piston. The power cylinder includes stop means, against which the ends of the reversing piston stems abut, slightly prior to the end of a stroke. This results in an inward displacement, on alternate strokes, of the reversing pistons, at least partially to collapse the high pressure fluid chamber between the reversing pistons.

The abutted reversing piston moves toward the reversing piston on the power side of the stroke to establish a chamber behind the abutted piston, which chamber is exhausted by connection to the low pressure fluid side.

However, the abutted piston cannot move, and thus the high pressure fluid trapped within the collapsible chamber exerts all of its force against the unabutted reversing piston to cause movement equal to the space provided by the second-mentioned chamber. This movement is sufficient to crack the valving arrangement in the opposite direction to reverse the high pressure flow to the opposite end of the power piston, which cycle is automatically repeated at the end of each stroke through the symmetrical arrangement.

The foregoing may be better understood from a reading of the following detailed description of the invention when taken in light of the accompanying drawings wherein.

Figure 1:
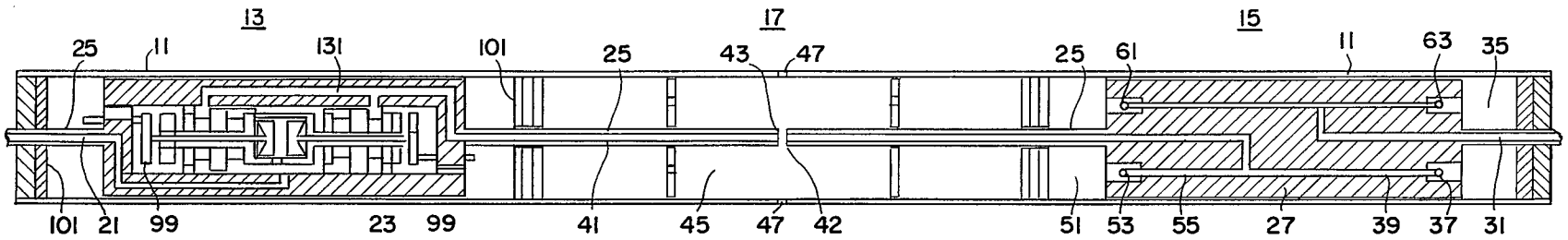
FIG. 1 is a sectional view of a motor and pump showing the pressure fluid paths through the motor portion and the recovery paths for fluid pumped by it to the surface.

In FIG. 1 a housing 11 includes an upper motor portion 13 and a lower pump portion 15, with an intermediate outlet portion 17.

Driving fluid is pumped from the surface through conduit 21 to operate motor piston 23 reciprocally up and down. A tubular shaft 25 rigidly connects motor piston 23 to pump piston 27 for like reciprocal movement.

The pump 15 is at least partially submerged in the production fluids to be pumped to the surface via inlet conduit 31. As pump piston 27 moves downwardly, fluid in chamber 35 is forced to pass through inlet ball valve 37 and via conduits 39 and 41 to tubular conduit 25 which includes peripheral openings, such as 42 and 43, for fluid passage into chamber 45 and thence via peripheral outlets, such as 47, through housing 11 and a conduit not shown to a surface farm tank. Also, as pump piston 27 moves upwardly, the fluid in upper pump chamber 51 passes through inlet ball seat valve 53 and via conduit 55 into common conduit 41 for pumping to the farm tank along the same path previously described.

On the downward stroke, ball seat valve 61 admits fluid to upper chamber 51 via inlet 31 and on the upward stroke via inlet passage through valve 63 into chamber 35.

The valve and valving arrangement of the motor 13 are best depicted in the remaining figures to control the reciprocating pumping action of piston 27 of pump 15.

Figure 3:
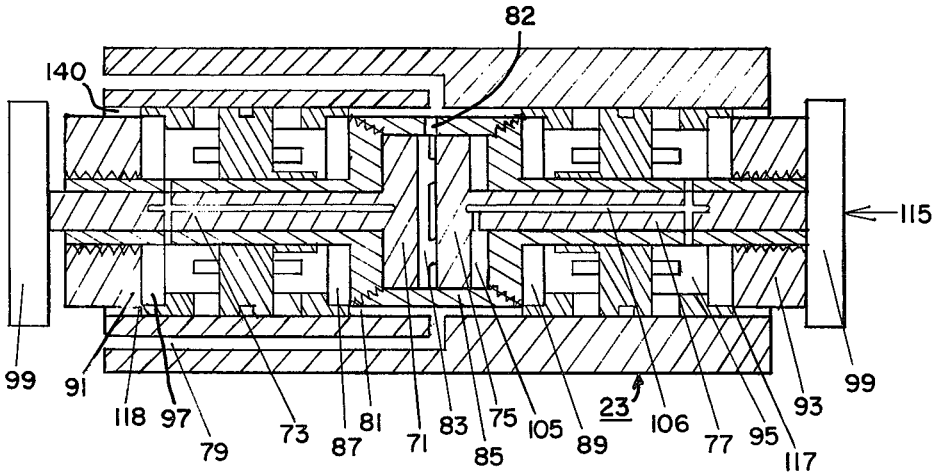
FIG. 3 shows the valve portion of the motor piston with the components positioned as they are at the end of either stroke, with all passageways closed, and particularly depicting the inlet high pressure passage.

In FIG. 3, the piston 23 is shown in detail including upper reversing piston 71 with stem 73, and lower reversing piston 75 with stem 77. High pressure conduit 79 admits fluid to annular chamber 81 and via passageway 82 into collapsible chamber 83 formed between the reversing pistons 71 and 75 within cylindrical inlet valve 85 which internally comprises the cylinder for reversing pistons 71 and 75. In FIG. 3, the reversing valve is shown in its center position with all ports closed because the piston is in its extreme lower end position preparatory to reversing its stroke. Valve 85 has closed off chamber 81 from inlet high pressure chambers 87 and 89, and exhaust valves 91 and 93 have closed off exhaust chambers 95 and 97.

Figure 2:
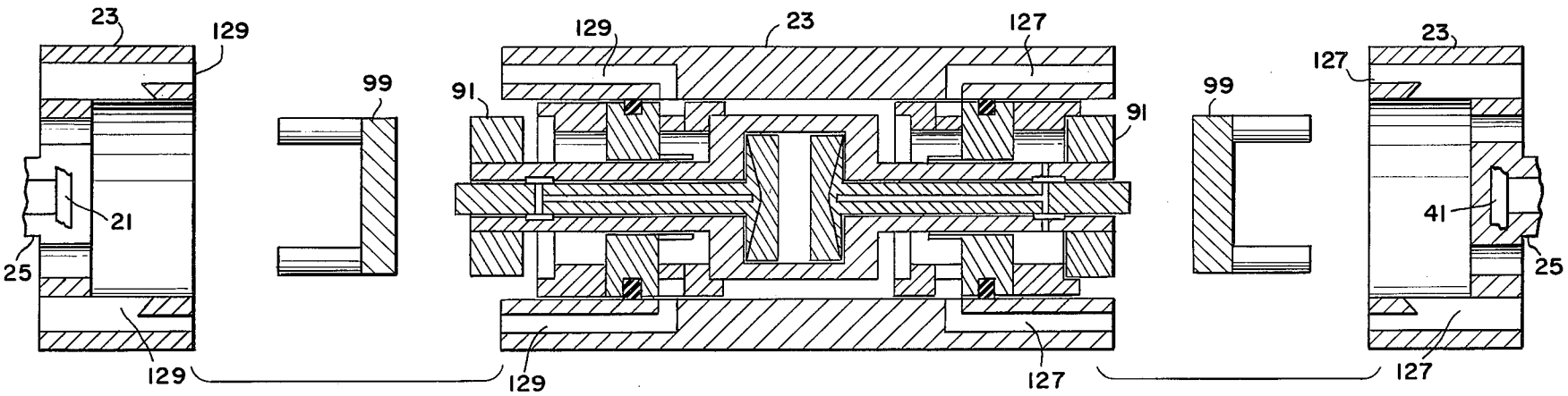
FIG. 2 is a sectional view of the motor portion of FIG. 1 showing the dual passage flow through the motor portion by accomodating a greater capacity.

From FIG. 3 it may be seen that stem 77 is in abutting engagement with U-shaped slide 99 which in turn is abutting against stop 101 (FIG. 1) comprising the lower end of that portion of housing 11 comprising the cylinder for motor 13. The U-shaped slide 99 is best seen in FIG. 2 relative to exhaust valve 91, because FIG. 2 is a sectional view of a portion of FIG. 1, revolved approximately 120°.

Returning now to FIG. 3, it may be appreciated that due to this abutting engagement, reversing piston 75 has been displaced upwardly, partially closing collapsible chamber 83, and forming a further chamber 105, on the rearward side of reversing piston 75. Chamber 105 exhausts via conduit 106 to exhaust chamber 95 so that the inlet valve 85 can move upwardly sufficiently to crack the inlet port to chamber 89, in turn admitting high pressure flow from chamber 81 and conduit 79 to reverse the stroke. Also, exhaust port 140 between chamber 97 and exhaust valve 91 is opened at the same time to permit the foregoing action.

It should be noted that, since the lower end of stem 77 is firmly fixed against movement, the high pressure in collapsible chamber 83 actually pushes against upper reversing piston 71 to move the exhaust and inlet valving member to the left or upwardly by exhausting the additional chamber 105.

Figure 6:
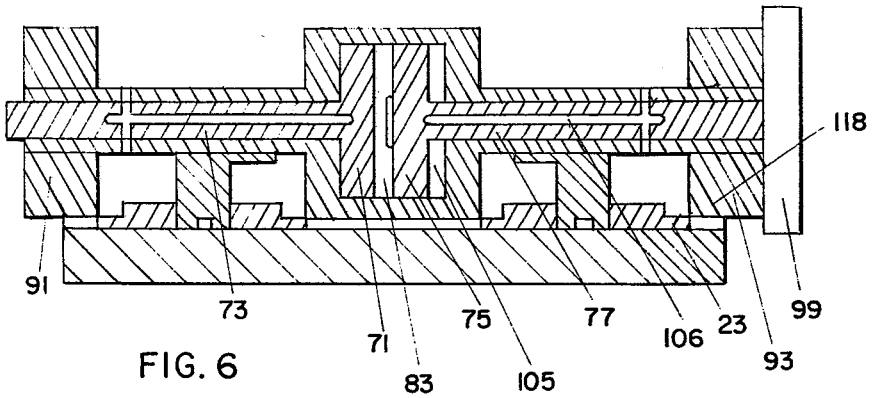
FIG. 6 is a partial view of the valve structure corresponding to FIG. 3.

The foregoing action is also clearly apparent from FIGS. 6 and 7, wherein FIG. 6 represents the end of a stroke, as just described in connection with FIG. 3, and shows the valving member with the arrow 115 on exhaust valve 93 indicating the direction of movement to close additional chamber 105. The lower portion of power piston 23 clearly shows the exhaust port 117 operation, i.e., remaining closed and the opening of the exhaust port 118 by movement of exhaust valve 93.

Figure 4:
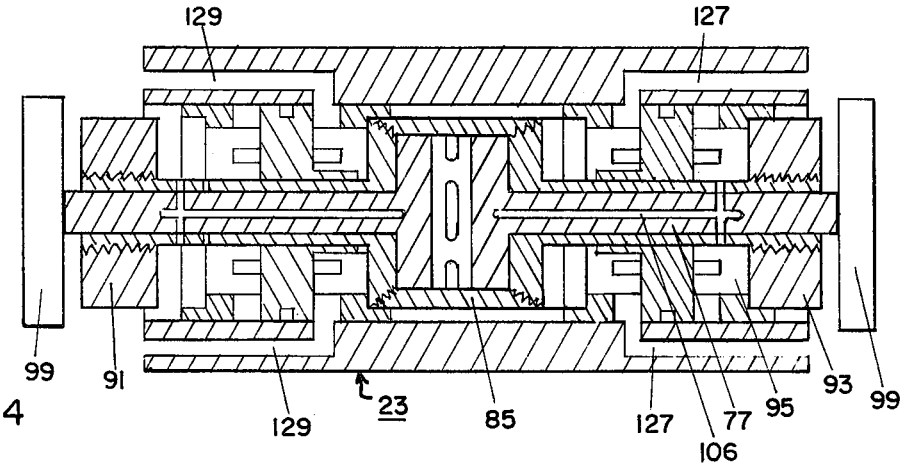
FIG. 4 is a further sectional view of the valve portion of the motor piston with the components in operative position to inlet high pressure fluid to force the power piston downwardly.
Figure 5:
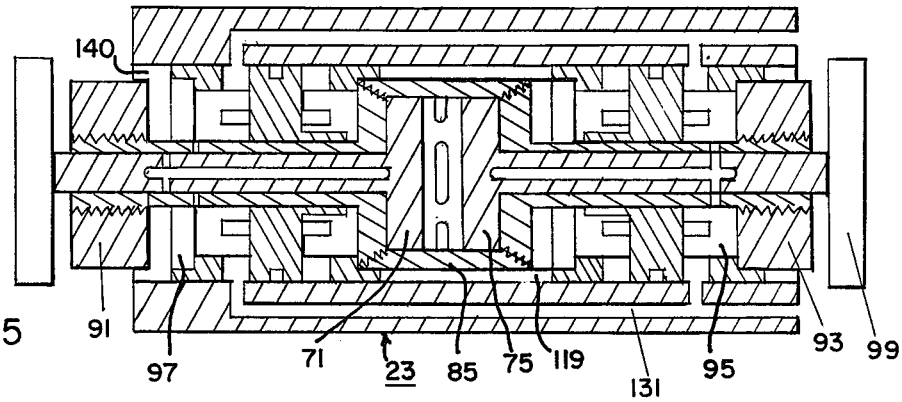
FIG. 5 is a further sectional view of the valve portion of the motor piston revolved approximately 120° from the sectional view of FIG. 4, with the power piston moving downwardly and exhausting the bottom portion of the motor cylinder.
Figure 7:
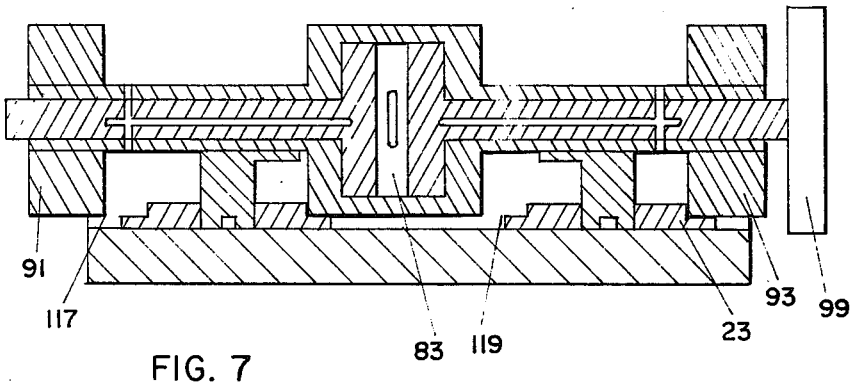
FIG. 7 is a partial view of the valve structure corresponding to FIGS. 4 and 5.

FIG. 7 depicts, in a simplified manner, the operation of FIGS. 4 and 5. This operation comprises a downward stroke for piston 23, to open upper inlet port 119 and lower exhaust port 117. The extension of the lower end of reversing piston stem 77, beyond exhaust valve 91, is clearly seen in this picture. Thus, in FIG. 4, exhaust port 117 is shown open and inlet port 119 is also shown open for the downward stroke.

When viewed from a sectional view at 120° to FIG. 4, the structure of FIG. 5 additionally shows the interconnecting exhaust conduit 131 between chambers 97 and 95. In FIG. 5, the power piston 23 is moving downwardly to the right. Both chambers 97 and 95 are in communication with passageway 131. The inlet valve structure 85 is just cracking the high pressure inlet behind reversing piston 71 to force the valve structure 85 to the right. Chamber 97 is also open to exhaust at 117. The U-shaped member included in block 99, near the end of the stroke will strike the cylinder end shown at 101 in FIG. 1 to crack the high pressure inlet to the immediate right of valve structure 85 automatically to initiate the succeeding stroke. In this manner motor 13 can force to the surface twice as much fluid as is required to drive the same.

What is claimed is:

1. A reversing valve apparatus for alternately supplying high pressure fluid to either end of a power piston in a cylinder housing while connecting the other end to exhaust comprising, in combination:

a movable valve member reciprocally slidable within said piston comprising exhaust valve and pressure fluid inlet valve portions communicating with each end of the power piston;

opposed reciprocally movable reversing pistons, each having a reversing piston stem respectively oppositely extending beyond the inlet valve portion of said valve member with said pistons disposed within the inlet valve portion in spaced apart relation to define a collapsible chamber therebetween in communication with the supply of high pressure fluid;

stop means spaced apart within the cylinder for respectively restricting the motion of said reversing pistons through abutment by the stems thereof toward the end of opposite strokes to decrease the collapsible chamber by inward movement of a reversing piston and form an additional collapsible chamber directly behind the reversing piston;

said stems including passageways therealong for high pressure flow to exhaust; and, means including said stem passageways, connecting the additional chamber to the exhaust for exhausting said additional chamber when the high pressure expands said collapsible chamber following arrestment of either of said reversing pistons to, thereby, open an inlet valve and exhaust valve to opposite ends of the power piston.

2. The device of claim 1 wherein said apparatus comprises:

a pump piston;

a pump cylinder housing containing said pump piston and being in communication with said cylinder housing;

a rigid connection between said power piston and said pump piston for reciprocating the latter; and, valve means in said pump housing for admitting the fluid to be pumped to said pump piston during each stroke.

3. The device of claim 2 wherein said apparatus further comprises:

operating chambers on opposite ends of the inlet valve portion within said cylindrical housing for the power piston; and, said inlet valve portion being movable in opposite directions to admit high pressure fluids respectively to said operating chambers on alternate strokes.

4. The device of claim 3 wherein said apparatus further comprises:

a pair of exhaust chambers in the cylindrical housing for said power piston; and, said movable valve member exhausting said exhaust chambers on alternate strokes of the power piston by moving said exhaust valve portions oppositely.

5. The method of reversing the flow of pressure fluid for a power piston in a power cylinder comprising the steps of:

providing a movable valve means in the power piston to alternate exhaust and application of pressure fluid to opposite ends of the piston;

establishing a collapsible chamber for high pressure fluid within said valve;

driving the piston to the end of a stroke by applying high pressure fluid to one end thereof and exhausting low pressure fluid from the other end;

mechanically, at least partially, collapsing said chamber toward the end of said stroke while establishing a further chamber expanding in size complementary with said collapsing chamber;

expanding said collapsible chamber while exhausting said further chamber via passageways in stems of opposed reversing pistons to move said valve in a direction away from the further chamber whereupon the valve means reverves the fluid flow to said piston to apply the high pressure fluid to said other end and to exhaust low pressure fluid from said one end.

6. The method of claim 5 for pumping fluids comprising the further step of:

connecting said power piston to a reciprocating pump having an actuating member reciprocated by said piston to admit fluids to a pumping chamber on each stroke and deliver fluids from said pumping chamber on each stroke.

* * * * *